US005926938A

United States Patent [19]

Jarek et al.

[11] Patent Number: 5,926,938

[45] Date of Patent: Jul. 27, 1999

[54] METHOD FOR WORKING AN ELECTROFORMED MAGNETIC METAL SHEET

[75] Inventors: Mathias Jarek, Seligenstadt; Wolfgang Pott, Darmstadt; Hans Kragl, Ober-Ramstadt, all of Germany

[73] Assignee: Harting Elektro-Optische Bauteile GmbH & Co. KG, Bad Salzdetfurth, Germany

[21] Appl. No.: 08/858,986

[22] Filed: May 20, 1997

[30] Foreign Application Priority Data

Jun. 29, 1996 [DE] Germany ..... 196 26 215

[51] Int. Cl.[6] ..... B23P 13/04

[52] U.S. Cl. ..... 29/527.2; 29/557; 29/719; 269/8

[58] Field of Search ..... 29/527.2, 557, 29/719; 269/8

[56] References Cited

U.S. PATENT DOCUMENTS 3,801,293 4/1974 Kiser ..... 451/57

FOREIGN PATENT DOCUMENTS 0 660 315 6/1995 European Pat. Off. .

*Primary Examiner*—P. W. Echols
*Attorney, Agent, or Firm*—Kenyon & Kenyon

[57] ABSTRACT

To planarize an electroformed, magnetic metal sheet having micropatterns, the metal sheet is clamped on a magnet and is mechanically processed on the back side of the metal in such a way that it assumes a plane-parallel shape. Metal sheets can be used which are not stress-free and are obtained in a fast electroplating process. Multiple copying is possible.

8 Claims, 2 Drawing Sheets

METHOD FOR WORKING AN ELECTROFORMED MAGNETIC METAL SHEET

FIELD OF THE INVENTION

The present invention relates to a method for working an electroformed, magnetic metal sheet which has patterns, in particular recessed micropatterns.

BACKGROUND INFORMATION

As a rule, the starting point for the manufacture of highly planar mold inserts for shaping tools is a so-called master pattern. It can be produced using the Liga method, the photo-resist method, the silicon-micropattern method, or otherwise. The mold insert for the shaping tool is produced by electroforming a master patter which is microstructured. To obtain stress-free mold inserts, the electroplating must be carried out in a very stress-free manner and, at the same time, at great thickness, approximately 3–5 mm.

The sheets obtained by electroforming are ground and fit into the shaping tool. In this case, it is disadvantageous that the deposition rate during the electroplating must be adjusted to be very slow to achieve the necessary freedom from stress. The entire duration of an electroforming process can be up to four weeks. During this time, expensive equipment cannot be used. Another disadvantage is that, as a rule, only one mold insert can be produced from a master pattern. This duration of the electroforming leads to high costs. However, for reasons of quality the deposition rate needs to be slow, since deviations from the planarity in further shaping generations, e.g., in the third-generation sheet, are greater than in the first-generation sheet. If only one mold insert can be produced from a master pattern, then, in this case, the costs per mold insert increase as well (as a rule, producing a master pattern is expensive).

SUMMARY OF THE INVENTION

The method according to the present invention makes it possible to obtain particularly thin, about 1 mm, non-planar, electroformed nickel sheets so that they are absolutely plane-parallel, without adversely affecting the patterns. The present invention is particularly suited for stress-affected, thin nickel sheets which are aligned to be plane-parallel by mechanical working.

A plurality of mold inserts can be inexpensively produced by means of multiple copying methods. There is no need for a time-consuming, stress-free electroforming process with rigid, thick sheets which do not permit a multiple-copying method. In the case of "thick" electroplating, i.e., sheet thicknesses of more than 3 mm, no post-planarizing takes place during the regrinding since, because of its thickness, the sheet is almost completely rigid. Thus, in this method, the planarity of the mold insert is determined by the freedom from stress of the electroplating.

By means of suitable clamping, the metal sheets worked according to the method of the present invention can be aligned to be absolutely parallel relative to the shaping tool.

DETAILED DESCRIPTION

Figure 1:
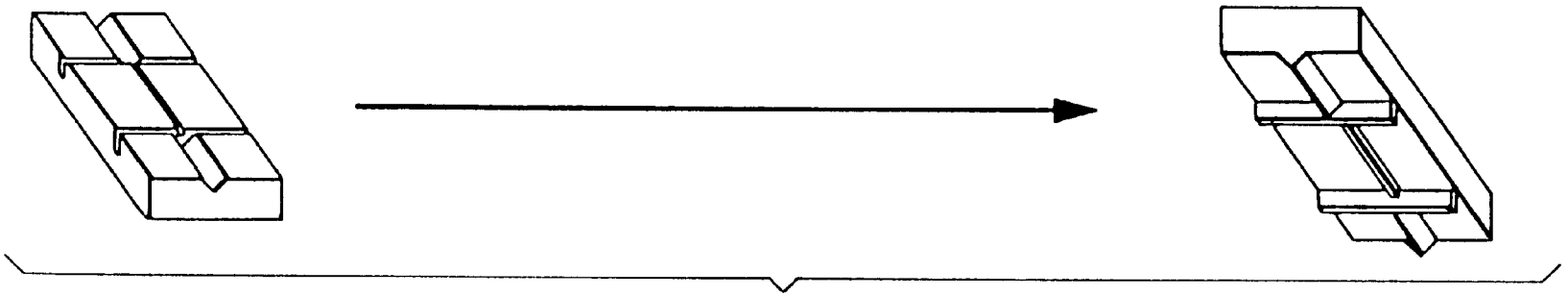
FIG. 1 shows the usual manufacture of a nickel sheet by means of electroforming.

FIG. 1 shows the conventional manufacture of an electroformed nickel sheet (nickel shim), provided with micropatterns, from a master pattern in "thick" electroplating. Such a nickel sheet is 3–6 mm thick, not flexible, and is produced by an extremely stress-free galvanic process, with a total duration for the electroforming of several weeks.

The shim planarity in the pattern zone (middle region between the V-grooves for the optical fiber couplings) is $\geqq 20\ \mu m$. Because of the duration of the electroforming process, and also for reasons of quality, this method is not suitable for producing multiple copies.

Figure 2:
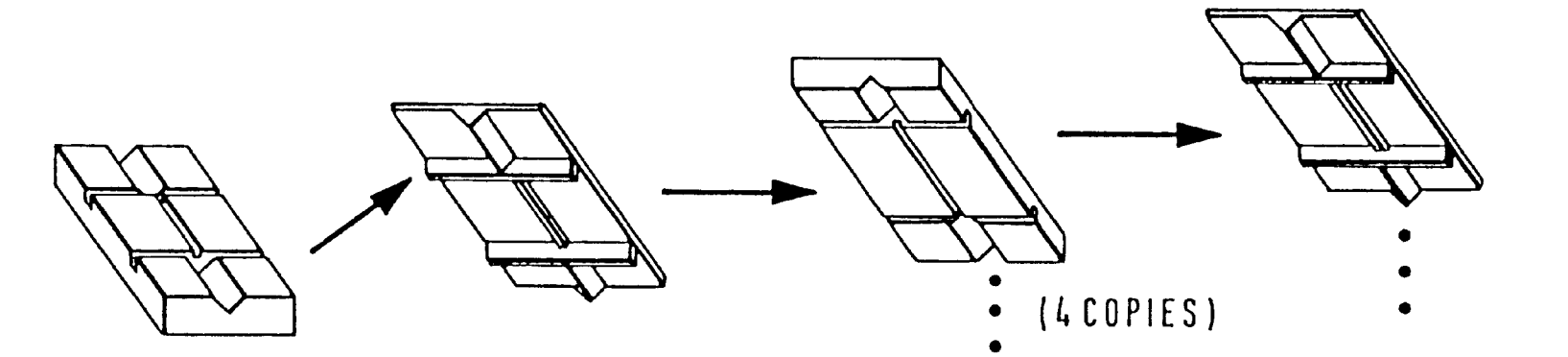
FIG. 2 shows the manufacture of a nickel sheet by electroforming by means of a multiple-copying method.

In the shaping process shown in FIG. 2, thin, about 1 mm thick, flexible nickel sheets which are not stress-free are shaped (formed) from a master pattern. A fast nickel-electroplating method is used with a process time of 1.5–14 hours per shim. If desired, multiple copies can be produced from these shims (FIG. 2 shows altogether 16 such copies) if, before or subsequently, they were worked with the method according to the present invention, as shown in FIGS. 3 to 5.

Figure 3:
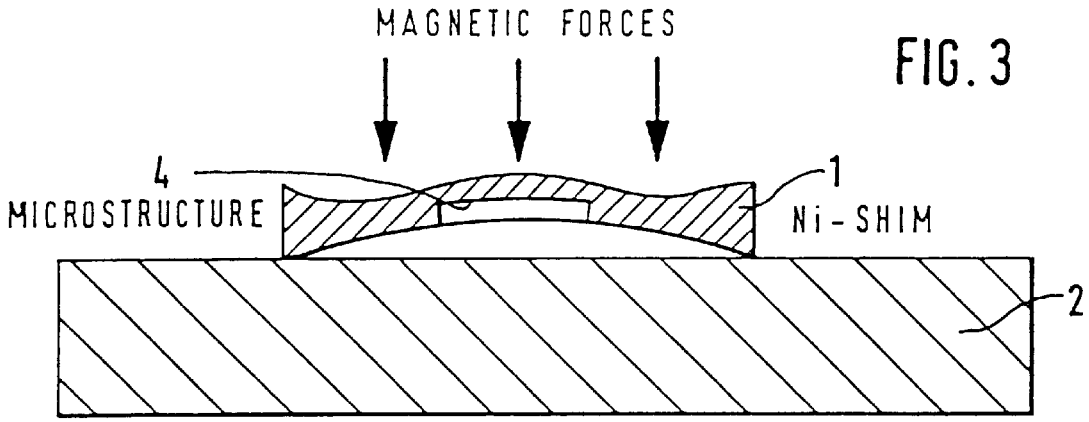
FIG. 3 shows the unprocessed nickel sheet, not stress-free, before the magnetic clamping.
Figure 6:
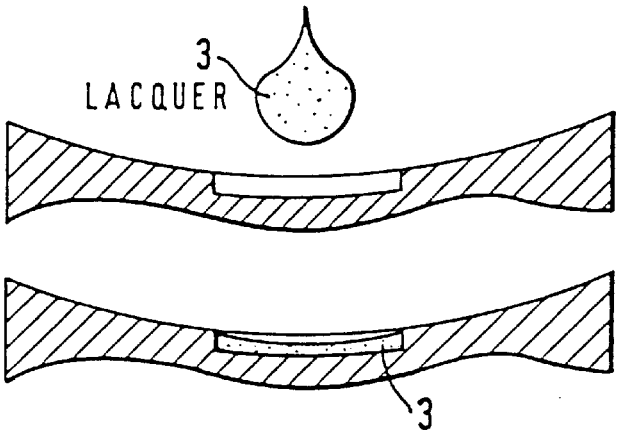
FIG. 6 shows the protection of the micropattern by lacquer.

As FIG. 3 shows, nickel sheet 1, electroformed from the master pattern and provided with recessed micropatterns 4, is curved, i.e., is not free of stress, and is not even of uniform thickness. The nickel sheet, still curved in FIG. 3, is held under magnetic forces against a magnetic clamping block (plane mounting table 2) which has been ground absolutely plane, magnet 2 having to be able to draw the nickel sheet in all regions onto its surface. The clamping is carried out in such a way that the pattern side of the nickel sheet points toward the magnetic surface of the magnet. A prerequisite for this is a sheet which is not too thick (under approximately 1.5 mm). Before the clamping, nickel sheets 1 with the recessed micropattern regions are pretreated for the grinding process, in that a drop of a lacquer 3, e.g., polymethyl acrylate, which is removable again later, dissolved in, e.g., ethyl acetate, is dripped into recess 4 in such a way that the bottom of the recess, as well as the micropatterns, are completely covered (FIG. 6).

In so doing, care must be taken that no lacquer gets on the shim surface. After drying, the micropattern is protected from damage during the grinding process, e.g., from metallic grinding dust or liquid grinding material. Metal sheet 1 is clamped onto magnet 2 in such a way that micropatterns 4 point toward magnet 2. The back side of the metal sheet is then mechanically processed in such a way that metal sheet 1 assumes a plane-parallel shape. This can be effected with a geometrically undefined cutting edge (grinding) or a geometrically defined cutting edge (milling, etc.), in particular with a surface grinding machine, a milling machine or a planing machine.

Figure 4:
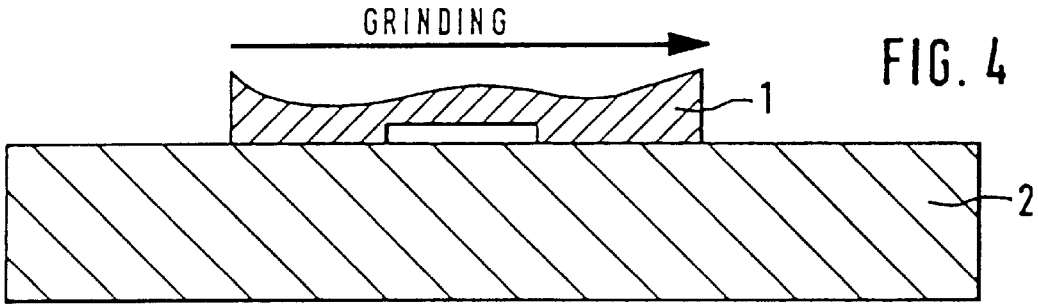
FIG. 4 shows the magnetically clamped nickel sheet.
Figure 5:
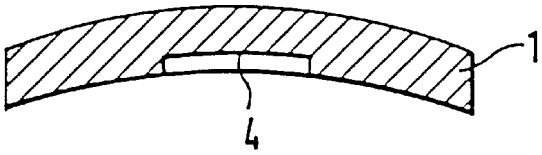
FIG. 5 shows the worked nickel sheet before mounting in a shaping tool.

FIG. 4 shows the processing direction of the grinding. After removal from the magnetic, plane mounting table, because of its stress, the worked, planarized nickel sheet resets again and assumes the curved shape according to FIG. 5. The protective lacquer 3 can be removed again, e.g., at 60° C. with chloroform.

After clamping the worked nickel sheet on a flat plate in a casting mold for the plastic modeling, the front side of the sheet is very plane. Over 40 mm, irregularities of about 8 $\mu$m were measured.

As a mold insert in a casting mold, the reworked nickel sheet is suitable for plastic modelings, and, in particular, for injection molding, hot stamping or reaction casting methods. It can be used especially advantageously for producing integrated optical waveguide components, for example, in accordance with German Patent Nos. P 44 01 219.5 or P 196 19 353.2, as well as for all other plane micropatterns. Instead of a magnetic plane mounting table having a permanent magnet, an electromagnetic plane mounting table can be used.

What is claimed is:

1. A method for working an electroformed, flexible magnetic metal sheet having a pattern side and a back side, comprising the steps of:

magnetically clamping the metal sheet on a magnet having a plane magnetic surface such that the pattern side of the metal sheet faces the plane magnetic surface of the magnet, the magnet drawing the metal sheet in all regions onto the plane magnetic surface; and mechanically processing the back side of the metal sheet such that the back side of the metal sheet forms a planar surface parallel to the pattern side.

2. The method according to claim 1, wherein the pattern side of the metal sheet includes recessed micropatterns.

3. The method according to claim 2, further comprising the step of applying a removable lacquer to the micropatterns before the clamping step.

4. The method according to claim 1, wherein the clamping step is performed using a magnetic plane mounting table.

5. The method according to claim 1, wherein the clamping step is performed using an electromagnetic plane mounting table.

6. The method according to claim 1, wherein the processing step includes the step of surface grinding the back side of the metal sheet using at least one of a surface grinding machine, a planing machine, and a milling machine.

7. The method according to claim 1, further comprising the step of using the processed metal sheet as a mold insert for a shaping tool.

8. The method according to claim 1, further comprising the step of using the processed metal sheet for plastic modeling using at least one of an injection molding, a hot stamping and a reaction casting technique.

* * * * *